US005096246A

United States Patent [19]

Cnare

[11] Patent Number: 5,096,246

[45] Date of Patent: Mar. 17, 1992

[54] BOTTLE CARRIER

[75] Inventor: Gordon C. Cnare, Pecatonica, Ill.

[73] Assignee: Hoover Universal, Inc., Plymouth, Mich.

[21] Appl. No.: 596,394

[22] Filed: Oct. 12, 1990

[51] Int. Cl.[5] ..... B65D 71/00

[52] U.S. Cl. ..... 294/87.2; 206/151; 206/427; 294/159

[58] Field of Search ..... 294/27.1, 31.2, 33, 294/87.2, 87.28, 90, 99.1, 145, 159, 166, 170; 206/142, 143, 145, 148, 150, 151, 158, 159, 162, 199, 201, 427, 428; 215/100 A

[56] References Cited

U.S. PATENT DOCUMENTS

| | | | |
|---|---|---|---|
| 2,849,110 | 8/1958 | Weiss | 294/159 X |
| 3,003,805 | 10/1961 | Glazer | 294/87.2 |
| 3,258,288 | 6/1966 | Courter | 206/159 X |
| 3,311,252 | 3/1967 | Swartwood et al. | 294/31.2 X |
| 3,633,962 | 1/1972 | Erickson | 294/87.2 |
| 4,093,295 | 6/1978 | Erickson | 294/87.2 |
| 4,159,841 | 7/1979 | Calvert | 294/87.2 |
| 4,235,468 | 11/1980 | Erickson | 294/87.2 |
| 4,247,142 | 1/1981 | Erickson | 294/87.2 |
| 4,360,231 | 11/1982 | Bolin | 294/87.2 |
| 4,372,598 | 2/1983 | Quelch | 294/87.2 |
| 4,523,677 | 6/1985 | Schurmann | 294/87.2 X |

FOREIGN PATENT DOCUMENTS

| | | | |
|---|---|---|---|
| 2068858 | 9/1971 | France | 294/87.2 |
| 2157257 | 10/1985 | United Kingdom | 294/31.2 |

*Primary Examiner*—Johnny D. Cherry
*Attorney, Agent, or Firm*—Harness, Dickey & Pierce

[57] ABSTRACT

A bottle carrier is provided for carrying containers and bottles having an annular neck ring formed in their neck regions. In particular, the bottle carrier includes a number of triangular support structures that are integrally formed with a handle. Each of the support structures has three connected legs which generally give the support structure a triangular shape and which also define a central insertion opening. Disposed at approximately the mid-section of each leg is a ramped support shoulder with an upper ledge. As the bottle is inserted through the insertion opening, the ramp of the support ledge engages the neck ring of the bottle. The engagement causes the shoulder and leg to be deflected outwardly. Once the neck ring has passed fully through the interior most dimension of the insertion opening, the legs and shoulders snap over the neck ring and back into their non-deflected positions. The bottle is then supported in a resting engagement the upper surface of the ledge.

11 Claims, 3 Drawing Sheets

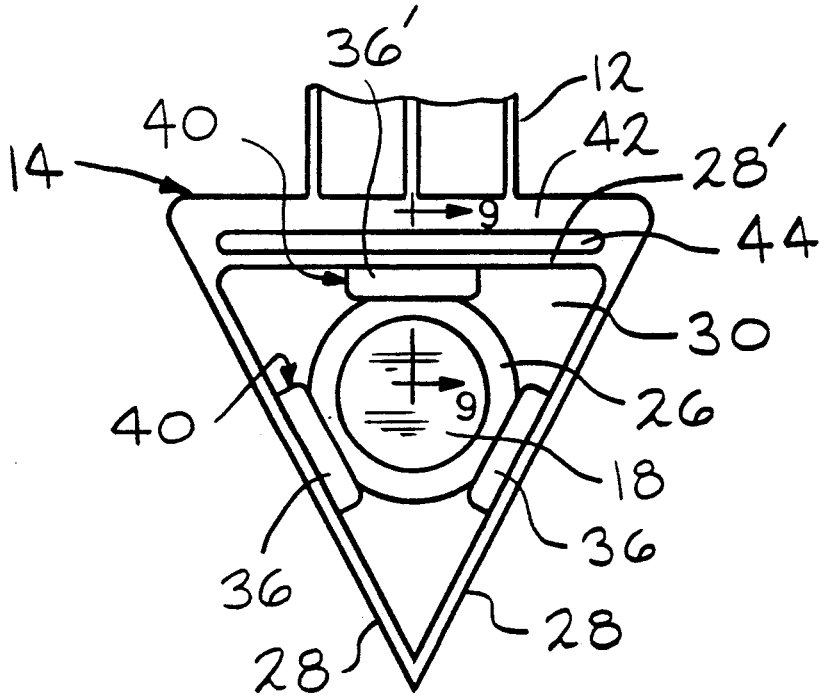
FIG 8
FIG 9
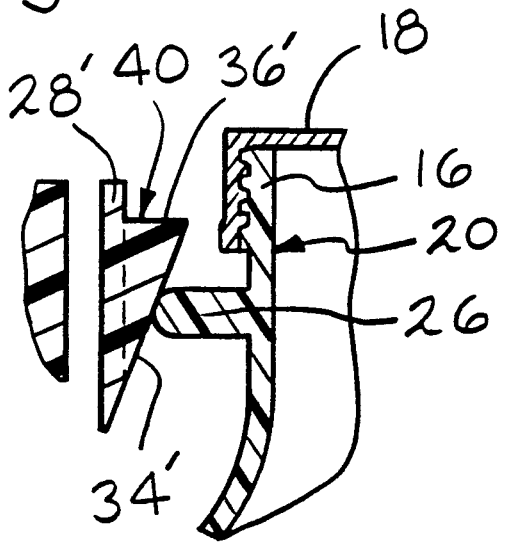

BOTTLE CARRIER

BACKGROUND AND SUMMARY OF THE INVENTION

The invention relates to a carrier for containers and, more particularly, to a hand held carrier for a multiple number of bottles exhibiting a generally annular, neck collar.

Beverages are now obtainable in a wide variety of containers. These containers include cartons, jugs, cans, bottles and soft sided pouches in numerous sizes and shapes. A common problem confronted in the manufacture of the containers is how to make them readily transportable and/or carriable by the consumer. One solution has been to incorporate a handle into the container itself.

While containers exhibiting handles are given various names, they are often referred to as jugs, two examples of which are the plastic milk jug and the liquid detergent jug. These containers are typically formed by extruding a high density polyethylene preform and blow molding the preform into conformity with a mold cavity. Prior to blow molding, the two halves of the mold are clamped around the extruded polyethylene preform. During clamping, a portion of the mold impales that portion of the polyethylene which will become the handle. Unfortunately, this procedure may not be employed with all the materials used to form containers.

Another method which provides a handle for carrying beverage containers is seen in the thin plastic rings commonly used with six containers or six-packs.

One container which is neither susceptible to the incorporation of a handle during blow molding nor to the incorporation thin plastic rings is the common two liter plastic bottle. While two liters is a common size, bottles formed by the method discussed below can be found in numerous volumetric configurations. These bottles are formed by blow molding polyethylene terephthalate (PET) and are commonly referred to as PET bottles. While PET is readily blown into conformity with the interior surfaces of a mold cavity, it is incapable of being extruded and lacks the characteristics necessary for incorporating a handle during the blowing process.

Typically, in blow molding a PET bottle, a parison or preform is heated and positioned in a mold cavity. The parison is secured and aligned within the mold by the mold clamping around a closure mouth and a neck ring or collar formed on the neck of the preform. Once adequately heated, the parison is blown into conformity with a mold cavity exhibiting the desired bottle shape. When so formed, the PET bottles tend to exhibit a generally cylindrical shape which lacks any structure specifically designed to allow the consumer to grasp the bottle.

As seen above, a limitation of the PET bottle is the awkwardness with which it is carried. If only one bottle is being carried, the problem is not overly burdensome. The bottle is merely grasped about its midsection or, alternatively, by two fingers on opposing sides of the neck region beneath the neck collar, and carried in that manner. However, when attempting to carry two or more bottles, the problem becomes compounded and the difficulty increases.

It is therefore an object of the present invention to provide a carrier for two or more bottles.

It is a further object of the present invention to provide a carrier from which the bottles are readily removable, thus enabling reuse of the carrier.

It is another object of the present invention to provide a carrier for use with bottles exhibiting a neck ring or collar.

It is an additional object of the present invention to provide a carrier which is both inexpensive to produce and easy to use.

The present invention provides a bottle carrier which includes a central handle and a number of bottle supporting structures positioned therearound. The bottle supporting structures are generally triangular in shape and include three integrally connected sides or legs which define an opening through which the neck of the bottle may be inserted. Each leg is provided with an inwardly projecting shoulder. The shoulders cooperate to define an area having a radial dimension that is less than the radius of the neck ring, but greater than the radius of the closure mouth. The bottle is engaged with the carrier by inserting the closure mouth and neck ring up through the opening. The closure mouth passes through the opening but the neck ring engages an upwardly inclined ramp portion of the shoulder. Further insertion of the bottle causes the legs and shoulders to deflect outwardly. Complete insertion of the bottle will cause the neck ring to pass over a ledge on the shoulder. The shoulders and legs then snap over the neck ring allowing the bottle to be supported in the carrier by a nesting engagement between neck ring and the ledge of the shoulder. Once the desired number of bottles have been inserted into the carrier, the bottles may be easily carried by grasping and lifting the handle of the carrier.

Additional benefits and advantages of the present invention will become apparent to those skilled in the art to which this invention relates from the subsequent description of the preferred embodiments and the appended claims, taken in conjunction with the accompanying drawings.

BRIEF DESCRIPTION OF THE DRAWINGS

FIG. 8 is a partial plan view of a second embodiment of a bottle carrier incorporating the principles of the present invention; and FIG. 9 is a sectional view taken substantially along line 9—9 in FIG. 8 illustrating the relationship between the support structure and the bottle prior to insertion of the bottle.

DETAILED DESCRIPTION OF THE DRAWINGS

Figure 1:
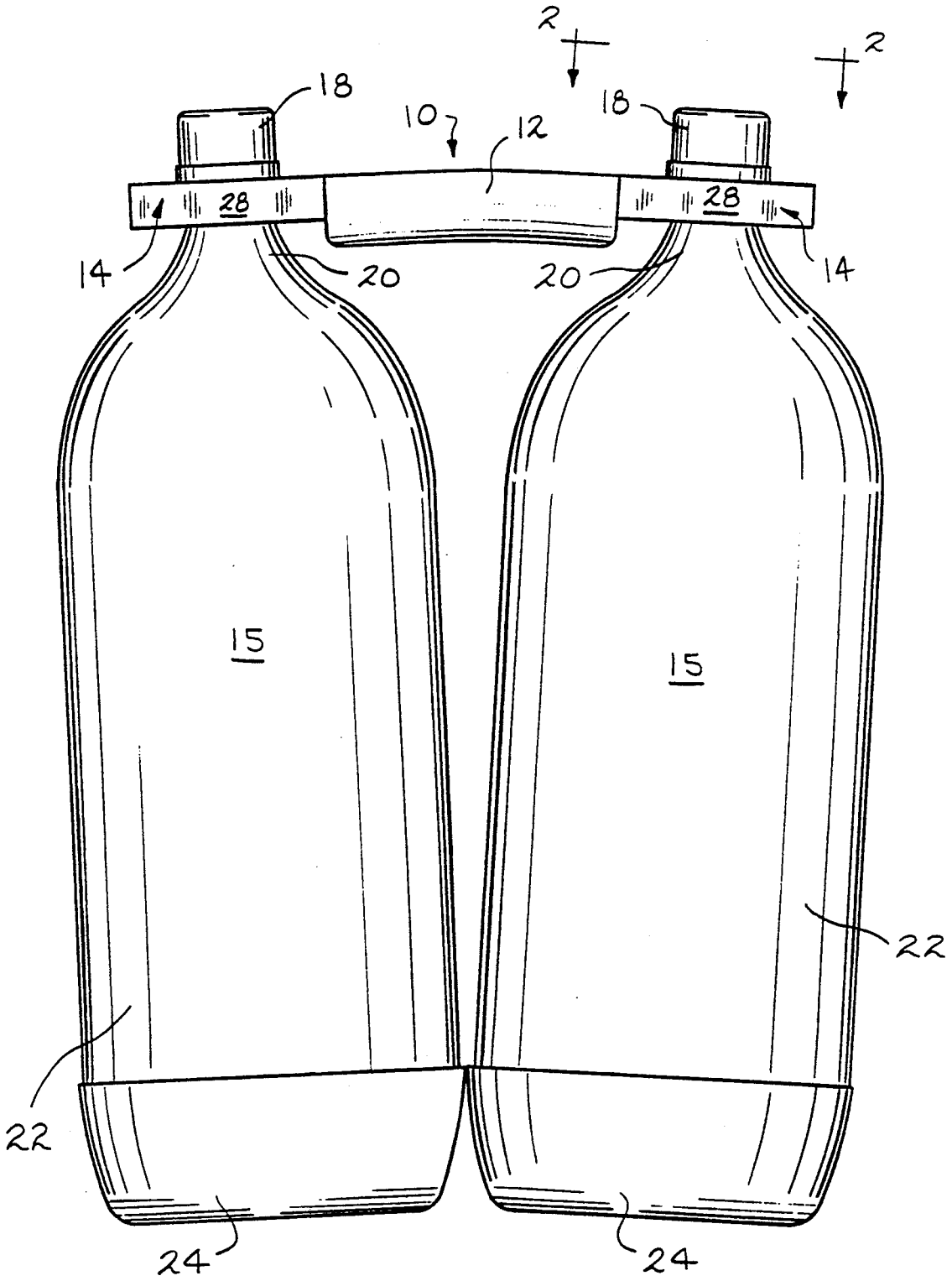
FIG. 1 is a side elevational view of a bottle carrier incorporating the principles of the present invention.

Now with reference to the drawing, FIG. 1 illustrates a bottle carrier, generally designated as 10, incorporating the principles of the present invention. The bottle carrier 10 includes a handle 12 and a plurality of support structures 14 positioned therearound. As will be further discussed below, the bottle carrier 10 is designed for use with a bottle 15 having a mouth 16, a closure cap 18, a neck portion 20, a sidewall 22 and a base 24. The neck portion 20 further includes a generally annular neck ring or collar 26. Such neck rings 26 are typically seen on blow molded polyethylene terephthalate bottles (hereinafter PET bottles), such as a two liter beverage bottle. While the carrier 10 is generally described as being used with PET bottles, it may also be used with bottles formed from other materials so long as they exhibit an appropriately sized neck ring 26.

A handle 12, having a size and shape which will allow a person to comfortably grip the carrier 10, is provided with a plurality of support structures 14. The present embodiment illustrates two support structures 14 integrally formed with the handle 12. However, it is readily seen that, if desired, a greater number of support structures 14 can be incorporated around the handle 12. For example, the triangular support structures 14 may be positioned adjacent to the four corners of the handle 12 to provide a four bottle carrier.

Each support structure 14 is shaped in a generally triangular shape that includes three integrally connected legs 28. The legs 28 may be formed in an isosceles triangle, equilateral triangle or similarly strong structure and are all oriented so as to lie substantially in a common plane. So constructed, the legs 28 join together to define an insertion opening 30 centrally located therebetween. The insertion opening 30 is formed of a size which will allow the neck portion 20 of the bottle 15, including the neck ring 26 and the closure cap 18, to be inserted therethrough.

In that each leg 28 is similarly constructed, only one leg 28 will be discussed in detail. The bottles 15 are inserted into the carrier 10 u through the insertion opening 30. Thus, for each bottle 15 and support structure 14, the center of the insertion opening 30 defines a point along the axis of insertion.

Each leg 28 is provided with an abutment or support shoulder 32 that is directed inward of the insertion opening 30. The shoulder 32 is positioned in approximately the midsection of the leg 28 and includes an inwardly angled ramping portion 34 and a generally horizontal ledge portion 36. Progressing along the insertion axis and up through the support structure 14, the ramp 34 is inclined so as to increase the radial distance it extends from the leg 28 into the insertion opening 30. The ramp 34 continues to extend into the opening 30 until terminating at an intersection with the ledge portion 36, which extends transversely back to the leg 28. The innermost portions of each ramp 34 and ledge 36 define three points on the circumference of an imaginary circle having a diameter greater than that of the closure cap 18, but less than the diameter of the neck ring 26. Thus, the ramp 34 and ledge 36 define the innermost dimension of the insertion opening 30.

Figure 2:
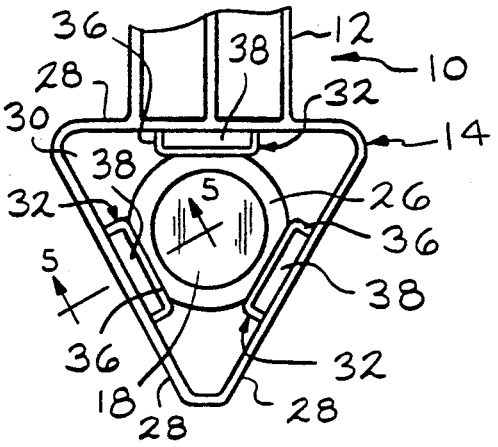
FIG. 2 is a partial plan view taken substantially along line 2—2 in FIG. 1 of the bottle carrier prior to insertion of the bottle.
Figure 3:
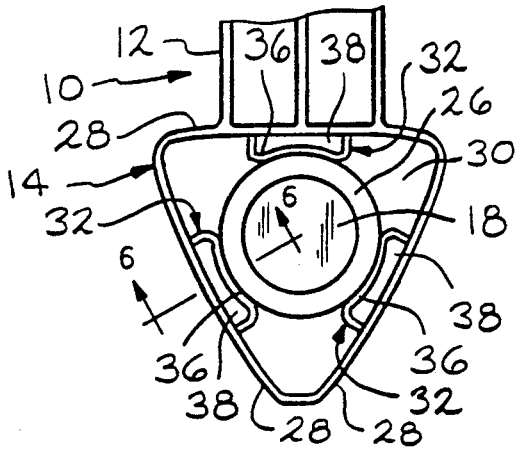
FIG. 3 is a partial plan view of the bottle carrier with the bottle partially inserted therethrough.
Figure 4:
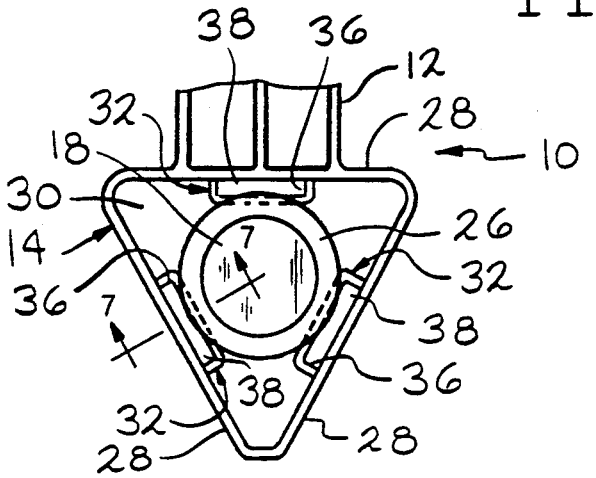
FIG. 4 is a partial plan view of the bottle carrier with the bottle fully extended therethrough.
Figure 5:
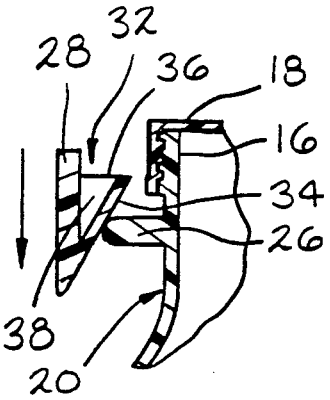
FIG. 5 is a sectional view taken substantially along line 5—5 in FIG. 2 prior to insertion of the bottle into the bottle carrier.
Figure 6:
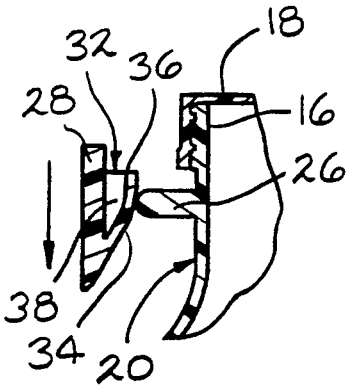
FIG. 6 is a sectional view taken substantially along line 6—6 in FIG. 3 illustrating the bottle carrier support structure deflecting upon the insertion of the bottle.
Figure 7:
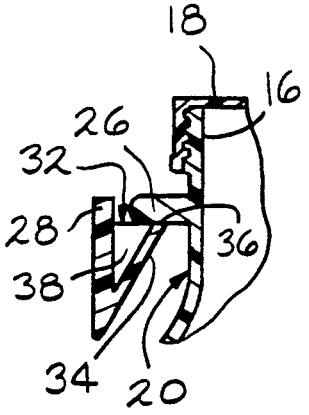
FIG. 7 is a sectional view taken substantially along line 7—7 in FIG. 4 illustrating the carrying position of the bottle and the engagement between the neck ring and the support ledge.

The insertion sequence of a bottle 15 into the carrier 10 is generally illustrated by FIGS. 2 through 7. At the beginning of insertion, the neck ring 26 of the bottle 15 initially engages a lower portion of each ramp 34, as seen in FIGS. 2 and 5. As previously stated, the diameter of the neck ring 26 is greater than that defined by the ramps 34. Thus, inserting the bottle 15 through the insertion opening 30 will cause each ramp 34, along with its corresponding leg 28, to progressively deflect outwardly (see FIGS. 3 and 6). By increasing or decreasing the inclination angle of the ramps 34, the force required for deflecting the legs 28 may be varied. To aid in this deflection, a hollow trough 38, having the ledge 36 as its upper rim, is centrally provided in each support shoulder 32. As the bottle is progressively inserted through the insertion opening 30, the neck ring 26 increasingly deflects the ramp 34 into the trough 38. This deflection of the ramp 34 will in turn cause the leg 28 to deflection outward (see FIG. 3).

Upon further insertion of the bottle 15, the neck ring 26 fully passes over both the ramp 34 and the ledge 36 of the support shoulder 32 allowing the shoulder 32 to snap over the neck ring 26 back into its pre-insertion position. When all of the support ledges 32 have snapped over the neck ring 26, the bottle 15 is properly positioned in its carrying position.

In the carrying position, the neck ring 26 is in a nesting engagement with the shoulder 32, and more particularly the ledge portion 36. It can be seen that upon lifting of the carrier 10, the bottle 15 will be suspended and supported by the coacting of the neck ring 26 and the ledge 36 of the support shoulder 32.

The carrier 10 is constructed of a substantially rigid plastic material. While the material is substantially rigid, the ramp 34 and the legs 28 are formed thin enough to permit their deflection during the insertion of the bottle 15. In this manner, the carrier 10 does exhibit some resilient characteristics. Upon the insertion of a number of bottles 15 into the support structures 14 of the carrier 10, the weight of the bottle contents may cause the carrier 10 to exhibit a slight downward bow. When bowed, the bases 24 of the adjacent bottles 15 are allowed to rest against one another in a substantially side by side relation. The resting of the adjacent bases against one another reduces the amount of "banging" or "clanking" which the bottles would otherwise exhibit. As an end result, the risk of damage to the bottles 15 themselves is reduced. Such damage might readily occur if the carrier 10 was being employed with glass bottles 15.

A second embodiment of the present invention is illustrated in FIGS. 8 and 9 and exhibits the same basic principles as the previous embodiment. Where appropriate, like elements have been designated with like references.

As with the previous embodiment, the support structures 14 of the second embodiment are generally triangular in shape and are defined by three integrally formed legs, designated at 28 and 28'. Centrally disposed on each leg 28' is a support shoulder 40 having a ramp 34 or 34' and a ledge 36 or 36'. Like the previous embodiment, innermost portions of the shoulder 40 lie on the circumference of a circle having a diameter less than the diameter of the neck ring 26. However, unlike the previous embodiment, the support shoulders 32 and 40 of the present embodiment is solid. The inclination and length of the ramp 34 or 34' may be varied to allow the lowermost portion of the ramps 34 and 34' to actually extend below the legs 28 and 28'. In this manner, the bottle 15 will be centered more easily and quickly with the support structure.

During the insertion of a bottle 15, each leg 28 and 28' is outwardly deflected by the solid shoulder 32 and 40 and the neck ring 26. In that the solid shoulder 40 would be unable to deflect a leg 28' attached to the handle 12 of the carrier 10, the present embodiment incorporates a bridge member 42. The bridge member 42 is integrally and transversely formed with the handle 12 but is spaced apart from the adjacent leg 28' in a substantially parallel fashion. The bridge member 42 and the adjacent leg 28' are integrally connected at their ends and cooperate to define a slot 44 therebetween. During insertion of a bottle 15, the slot 44 will permit adequate deflection of the adjacent leg 28' to allow the bottle 15 to be fully inserted into the support structure 14.

Removal of a bottle 15 from the carrier 10 is also easily accomplished. The neck 10 of the bottle 15 is first pushed in a generally horizontally direction against the support shoulder 32 (or 40) of one of the legs 28 or 28'. In actual use, this leg will most likely be the leg 28' adjacent to the handle 12 in that it will allow a compressive force to be applied to the support shoulder 40 between the neck portion 20 of the bottle 15 and the handle 12. The above mentioned force will cause the shoulder 40 and ramp 34' to deflect in an outward fashion. Once the shoulder 32 or 40 is outwardly deflected, the bottle 15 is tilted, so as to direct the closure cap 18 toward the deflected leg 28 or 28'. The bottle 15 is then twisted downward to cause the neck ring 26 to disengage and rotate out of the remaining shoulders 32 or 40.

While the above description constitutes the preferred embodiments of the present invention, it will be appreciated that the invention is susceptible to modification, variation and change without departing from the proper scope an fair meaning of the accompanying claims.

I claim:

1. A container carrier for beverage containers of the type including a closure mouth, a neck ring, a sidewall and a base, said container carrier comprising:

an elongated handle for grasping and picking up said container carrier; and a plurality of substantially rigid support structures attached to said handle, each of said structures having integrally connected legs generally defining a triangle having a central insertion opening of a size greater than the neck ring of the container and through which said neck ring may be inserted, a shoulder interiorly formed on each of said legs of said support structure, said shoulders extending inwardly of said insertion opening and including an inwardly angled ramp portion terminating in a generally horizontal ledge portion, said shoulders and said legs being outwardly deflectable upon the insertion of the neck ring through said insertion opening and resiliently snapping over the neck ring upon full insertion of the neck ring therethrough, said ledge portion thereafter being in resting engagement with the neck ring and the container being supported in said container carrier.

2. A container carrier as set forth in claim 1 wherein each of said legs includes a shoulder interiorly formed thereon.

3. A container carrier as set forth in claim 1 wherein said support structure is generally triangular in shape with said legs lying substantially in a common plane.

4. A container carrier as set forth in claim 1 wherein said legs are integrally connected so as to define an equilateral triangle.

5. A container carrier as set forth in claim 1 wherein said legs are integrally connected so as to define an isosceles triangle.

6. A container carrier as set forth in claim 1 wherein said shoulder further defines an open trough centrally formed therein, said trough being open in a direction toward said ledge portion, said ramp portion and said leg forming opposing sidewalls of said trough.

7. A container as set forth in claim 6 wherein said ramp portion is deflectable inward of said trough toward said leg during insertion of said neck ring through said insertion opening reducing the deflection of said leg.

8. A container carrier as set forth in claim 1 wherein said shoulder is solid.

9. A support and carrier structure for containers of the type including a closure mouth, a neck ring, a sidewall and a base, said support and carrier structure comprising;

a preshaped handle enabling the grasping of said support and carrier structure;

a plurality of support structures integrally formed with said handle and including three legs integrally connected in a substantially triangular shape defining an insertion opening centrally therein through which the neck ring may be inserted, said legs having interior surfaces further defining an outermost dimension of said insertion opening having a size greater than the neck ring;

a plurality of support shoulders formed medially on said interior surfaces of said legs, said shoulders including a ramp portion angled radially inward of said insertion opening and terminating in a ledge portion extending generally transversely from said interior surface of said leg into said insertion opening, said ramp portion and said ledge portion coinciding and terminating at an interior edge, said interior edges of said shoulders cooperating to define an innermost dimension of said insertion opening being of a size less than the neck ring, said shoulders and said legs being outwardly deflectable upon said ramp portions engaging the neck ring during insertion of the neck ring into said insertion opening, said shoulders snapping over the neck ring upon full insertion and the neck ring being retained and the container supported in a resting engagement with said ledge portions of said shoulders.

10. A support and carrier structure for containers as set forth in claim 9 wherein said shoulders further include portions defining an open trough centrally therein, said trough being open in the direction of said ledge portion.

11. A support and carrier structure for containers as set forth in claim 9 wherein said carrier structure further comprises a bridge member formed integrally adjacent to said handle and having ends connected to one of said legs, said bridge member being spaced apart from said one leg in a substantially parallel fashion so as to define a slot portion therebetween and allowing deflection of said one leg toward said bridge member during insertion of the neck ring into said insertion opening.

* * * * *